US005474430A

United States Patent [19]

Oberklammer

[11] Patent Number: 5,474,430

[45] Date of Patent: Dec. 12, 1995

[54] FUEL INJECTION PUMP

[75] Inventor: Kurt Oberklammer, Neuhofen/Ybbs, Austria

[73] Assignee: Robert Bosch GmbH, Stuttgart, Germany

[21] Appl. No.: 201,960

[22] Filed: Feb. 25, 1994

[30] Foreign Application Priority Data

Mar. 6, 1993 [DE] Germany ..... 43 07 111.2

[51] Int. Cl.[6] ..... F02M 51/00; F02M 53/02

[52] U.S. Cl. ..... 417/500; 123/449

[58] Field of Search ..... 417/500, 289; 123/449

[56] References Cited

U.S. PATENT DOCUMENTS

| | | | |
|---|---|---|---|
| 2,699,766 | 1/1955 | Fodor . | |
| 2,759,422 | 8/1956 | Miller . | |
| 4,470,763 | 9/1984 | Yasuhara | 417/500 X |
| 4,793,313 | 12/1988 | Paganon et al. | 123/506 |

FOREIGN PATENT DOCUMENTS

| | | | |
|---|---|---|---|
| 0192978 | 1/1986 | European Pat. Off. . | |
| 1734877 | 11/1956 | Germany . | |
| 147544 | 3/1985 | Japan . | |
| 783406 | 9/1957 | United Kingdom . | |
| 814589 | 6/1959 | United Kingdom | 123/449 |

*Primary Examiner*—Richard E. Gluck
*Attorney, Agent, or Firm*—Edwin E. Greigg; Ronald E. Greigg

[57] ABSTRACT

A fuel injection pump of the distributor type for a multicylinder internal combustion engine has a pump piston that both rotates and is driven in the lifting direction for generating a fuel injection pressure in a pump work chamber, and a magnet valve that blocks and unblocks the pump work chamber in the direction of a relief conduit for designating the beginning and end of pumping. The rotational movement of the pump piston is generated by a drive shaft and its lifting motion is generated by a cam drive. For use of the fuel injection pump in an engine having more than four cylinders, the cam drive has a first cam disk connected to the pump piston in a manner fixed against relative rotation with front cams, and a second cam disk connected to the drive shaft in a manner fixed against relative rotation with front cams. An unrotatable but axially displaceable roller holder supports rollers that roll off respectively one of the cam disks.

8 Claims, 4 Drawing Sheets

FUEL INJECTION PUMP

The invention is based on a fuel injection pump of the distributor type for a multicylinder internal combustion engine as defined hereinafter.

BACKGROUND OF THE INVENTION

In fuel injection pumps of this type, known for example from German Patent Publication DE 39 43 245 A1, the number of injection lines is limited to a maximum of four, because a sufficient injection adjustment is possible by means of the magnet valve with an angle of rotation of the cam disk of 90° still being available for a front cam of the cam disk. The injection adjustment is effected in that, by means of the opening and closing of the magnet valve during the piston stroke, the beginning and end of pumping of the pump piston are displaced to different cam angles, corresponding to the respective type of load, i.e., they begin sooner or later in relation to the angle of rotation of the cam disk. With a number of cylinders greater than four, because of the available angle of less than 90° per front cam, such an injection adjustment is associated with considerable problems, so that this simple injection adjustment must be abandoned by means of a magnet valve, and a mechanical-hydraulic injection adjustment is used.

OBJECT AND SUMMARY OF THE INVENTION

The fuel injection pump of the invention has the advantage that its use is also possible in engines with more than four cylinders with a sufficiently sensitive injection adjustment by means of the magnet valve. By means of the two cam disks and the first and second rollers, with smaller cam heights a greater stroke of the pump piston can be attained than with the known fuel injection pumps, because the cam heights of the two eccentric disks are combined for the pump piston stroke. A larger angle of displacement of the beginning of pumping can be attained by means of the greater stroke.

The cam drive comprising roller holders with two-level rollers and two cam disks is easily lubricated by means of being connected to the lubrication system of the engine cycle. Lubrication with fuel is likewise possible, for which purpose the interior chamber of the pump receiving the cam drive is filled with fuel in a known way and coupled with the drive shaft of a fuel pump rotating in the interior chamber of the pump.

Advantageous further developments and improvements of the fuel injection pump disclosed are possible by means of the measures listed hereinafter.

Through the use of a total of four first rollers that roll off of the first cam disk connected to the pump piston in a manner fixed against relative rotation, and likewise four second rollers that roll off of the second cam disk connected to the drive shaft in a manner fixed against relative rotation, greater stroke forces can be transmitted and received by the cam drive with less wear.

In an advantageous embodiment of the invention, the two cam disks are embodied with identical diameters, and the axes of the first and second rollers are disposed offset with respect to one another in the axis direction of the roller holder. The cam embodiment of the two cam disks are identical, so that each cam disk contributes 50% of the piston stroke.

The axial staggering of the rollers and the increased overall length of the fuel injection pump associated with it can be kept small, because the axial spacing of the roller shafts is selected to be smaller than the roller diameter and the shafts of the first and second rollers are radially rotated with respect to each other sufficiently so that the rollers do not touch one another.

In an advantageous embodiment of the invention, the diameter of the first cam disk connected to the pump piston in a manner fixed against relative rotation is selected to be smaller than that of the second cam disk connected to the drive shaft in a manner fixed against relative rotation. The first and second rollers are disposed one behind the other with their axes radially aligned. In this embodiment the total pump length of the fuel injection pump is not increased. But because of the lager cam race radius, the cam disk with the larger diameter takes over more than 50% of the total stroke. The difference of the piston stroke is realized via the first cam disk connected to the pump piston in a manner fixed against relative rotation. Because of its smaller cam race radius, this cam disk has a smaller mass, which is advantageous because this cam disk performs the entire stroke of the pump piston.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
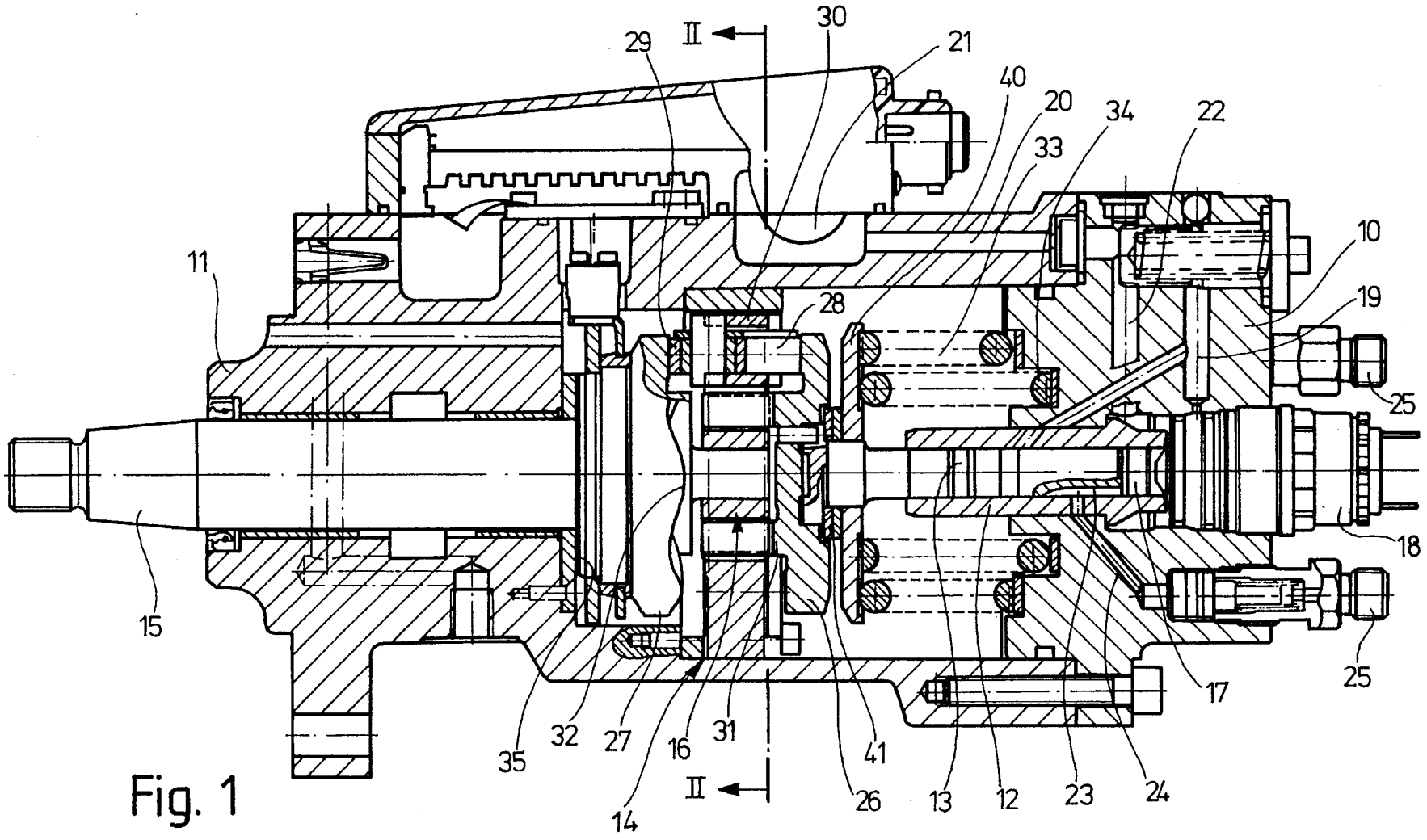
FIG. 1 shows a longitudinal section of a fuel injection pump for a multicylinder internal combustion engine.

In the fuel injection pump shown in longitudinal section in FIG. 1, a bushing 12, in which a pump piston 13 acting simultaneously as a distributor executes a back-and-forth movement and, at the same time, a rotating movement, is disposed in a front cover 10 that closes a pump housing 11. For this purpose a drive shaft 15 is rotatably seated in the pump housing 11 and is connected in a manner fixed against relative rotation to the pump piston 13 via a claw coupling 16 that permits an axial relative movement between the pump piston 13 and the drive shaft 15. The lifting motion of the pump piston 13 is generated by a cam drive 14 that is disposed inside the pump housing 11 and will be described in more detail later.

The drive shaft 15 rotates synchronously at the rpm of the engine supplied with fuel by the fuel injection pump and embodied with six cylinders, for example. A pump work chamber 17 whose front surface is sealed pressure-tight by the valve housing of a magnet valve 18 is defined by the front surface of the pump piston 13 and the bushing 12. The magnet valve 18 controls a relief conduit 19 that discharges at one end in the pump work chamber 17 and at the other end, via a bore 20, in a fuel pump chamber 21 that is filled with fuel and is maintained at pumping pressure by a fuel feed pump. Moreover, a supply bore 22, which extends in the front cover 10 and via which the pump work chamber 17 is filled with fuel from the fuel pump chamber 21, is connected to the bore 20.

The fuel is distributed from the pump work chamber 17 at an appropriate rotational position of the pump piston 13 via a distribution groove 23 in the pump piston 13 to pressure lines 24 embodied in the bushing 12 and in the front cover 10 as bores, and are disposed uniformly distributed over the circumference of the bushing 12 in a number corresponding to the number of cylinders in the engine, in this case six. Each pressure line 24 leads to an injection valve via a constant-pressure valve 25.

During the intake stroke of the pump piston 13, the pump work chamber 17 is filled with fuel from the fuel pump chamber via the supply bore 22. During the following pressure stroke, the fuel is brought to injection pressure inside the pump work chamber 17 and pumped via the distribution groove 23 to one of the pressure lines 24, and injected into the respective cylinder of the internal combustion engine via the injection nozzles. In this case, the beginning and end of injection are controlled by the magnet valve 18 as a function of different operating characteristics of the engine such as load, rpm, temperature and other factors. In its non-excited state, the magnet valve 18 is open, and unblocks the relief conduit 19. An injection pressure sufficient to open the injection nozzles 25 cannot build up in the pump work chamber 17. When the magnet valve 18 is excited, the relief conduit 19 is blocked. The beginning of pumping FB of the pump piston 13 is characterized by this, and a pressure buildup is effected in the pump work chamber 17. Fuel is pumped via the distribution groove 23 to the injection nozzles 25 and injected into the cylinders of the engine. The end of excitation of the magnet valve 18 is synonymous with the end of pumping FE of the pump piston 13, because the relief conduit 19 is opened by means of this, and a drop in pressure is effected in the pump work chamber 17. In the interim between the beginning of pumping FB and the end of pumping FE, a metered quantity of fuel is injected into a cylinder of the engine via respectively one of the injection nozzles 25. This injected quantity of fuel represents a partial quantity of the maximum possible quantity of fuel that can be pumped during one pumping stroke of the pump piston 13.

The cam drive 14 that generates the stroke of the pump piston 13 comprises a first cam disk 26 connected in a manner fixed against relative rotation to the pump piston 13, and a second cam disk connected to the drive shaft 15 in a manner fixed against relative rotation, and first rollers 28 that roll off of the first cam disk 26 and second rollers 29 that roll off of the second cam disk 27. The first and second rollers 28, 29, of which respectively four are disposed offset with respect to one another by respectively a circumferential angle of 90°, are disposed in two axially offset planes in a roller holder 30. The roller holder 30 is held in a manner fixed against relative rotation, but axially displaceably, in the pump housing 11, coaxially to the axis of the pump piston 13 and the drive shaft 15. Each cam disk 26, 27 supports a number of front cams 31 or 32 that corresponds to the number of cylinders of the engine and that generate the stroke of the pump piston 13 during the rotation of the cam disks 26, 27. The pump piston stroke is fixed by the sum of the heights of the front cams on both cam disks 26, 27. A pressure spring realized here by two helical pressure springs 33, 34 disposed coaxially to one another, is supported on one side against the front cover 10 and on the other side on a plate spring 40, which in turn is supported against the first cam disk 26 via an axial bearing 41. These helical pressure springs 33, 34 press the rollers 28, 29 and the front cams 31, 32 against one another, so that they remain engaged during the lifting movement of the pump piston 13. The second cam disk 27 is connected to the drive shaft 15 in a manner fixed against relative rotation in turn is supported via an axial bearing 35 on a shoulder of the pump housing 11.

Figure 2:
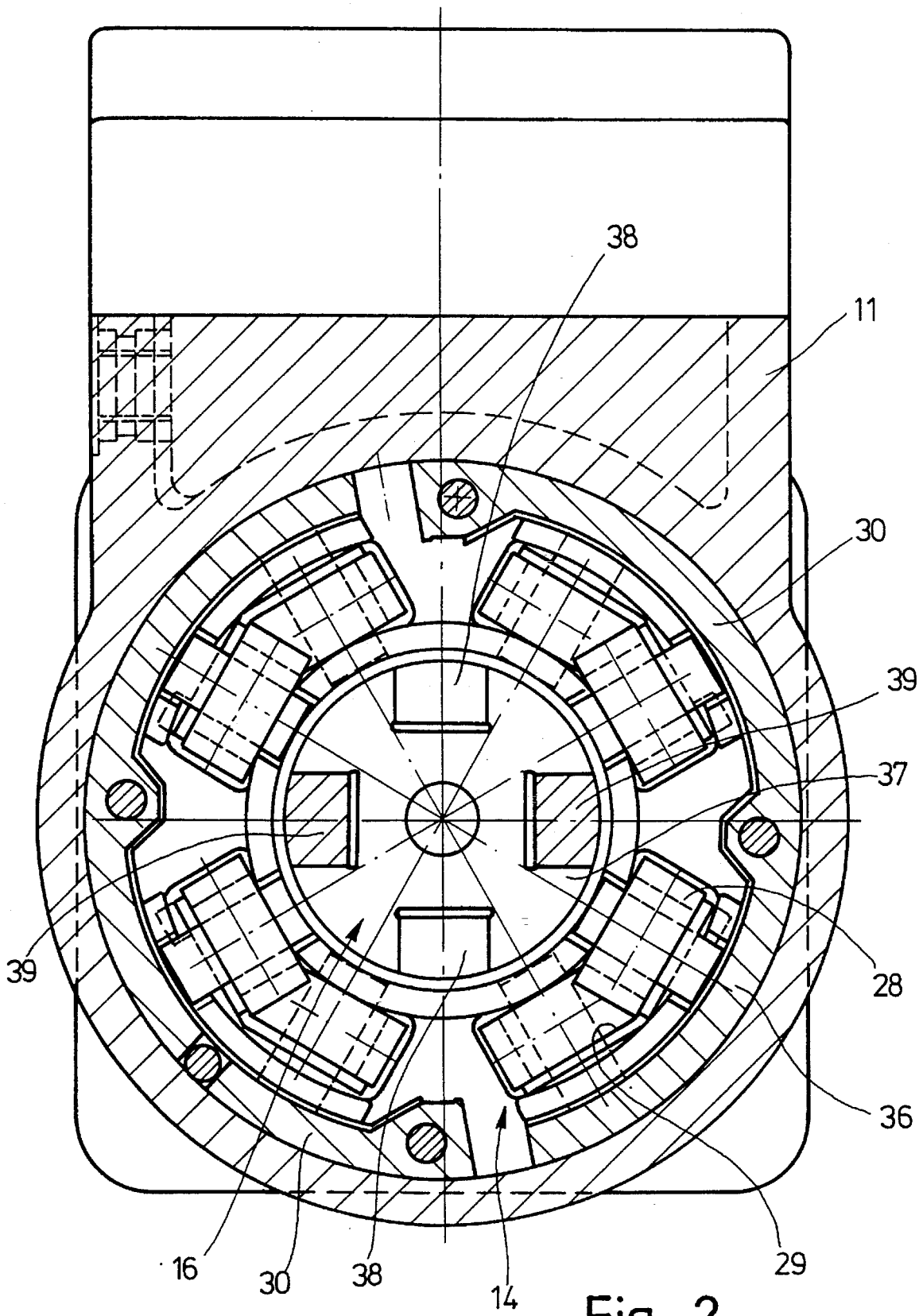
FIG. 2 shows a section along the line II—II in FIG. 1.

As can be seen particularly from FIG. 2, the seating of the roller holder 30, which is both axially displaceable and fixed against relative rotation, is effected by means of a guide ring 36 clamped securely in the pump housing 11. The roller holder 30 receives the rollers 28 and 29, which have a radially-oriented roller axis so that they can rotate. In principle the first rollers 28 and the second rollers 29 could be disposed with their axes oriented parallel to one another in two planes offset axially with respect to one another. This axial spacing, however, is included in the entire length of the fuel injection pump. To keep this length as small as possible, the axial axis spacings between the rollers 28 and the rollers 29 are made smaller than the diameter of the rollers 28, 29, and the axes of the first rollers 28 are rotated around a circumferential angle sufficiently with respect to the axes of the second rollers 29 that the rolling surfaces of the rollers 28, 29 do not touch (FIG. 2). In this arrangement the two cam disks 26, 27 have the same diameter. The number of four first rollers 28 and four second rollers 29 is not mandatory; however, the axial forces that arise during operation can be transmitted better with a plurality of rollers. To distribute more than four rollers 28 or 29 uniformly over the circumference in each roller plane is difficult for spatial reasons.

Because the two cam disks are of the same diameter, and the cam race radii are correspondingly identical, the front cams 31, 32 are embodied identically on the two cam disks 26, 27. This means that each cam disk 26, 27 effects 50% of the piston stroke of the pump piston 13. The distribution of the cam height on two cam disks 26, 27, which is necessary for the pump piston stroke, permits smaller front cams 31, 32 per cam disk 26, 27, because a larger number than four front cams 31, 32 can be disposed over a 360° circumferential angle of the cam disks 26, 27. The stroke of the pump piston 13, which is nevertheless great, allows a sufficient injection adjustment through the displacement of the pump region on the respective front cams 31, 32 by means of the magnet valve 18. The described fuel injection pump can thus be used without problems in an internal combustion engine having a greater number of cylinders than four.

Figure 3:
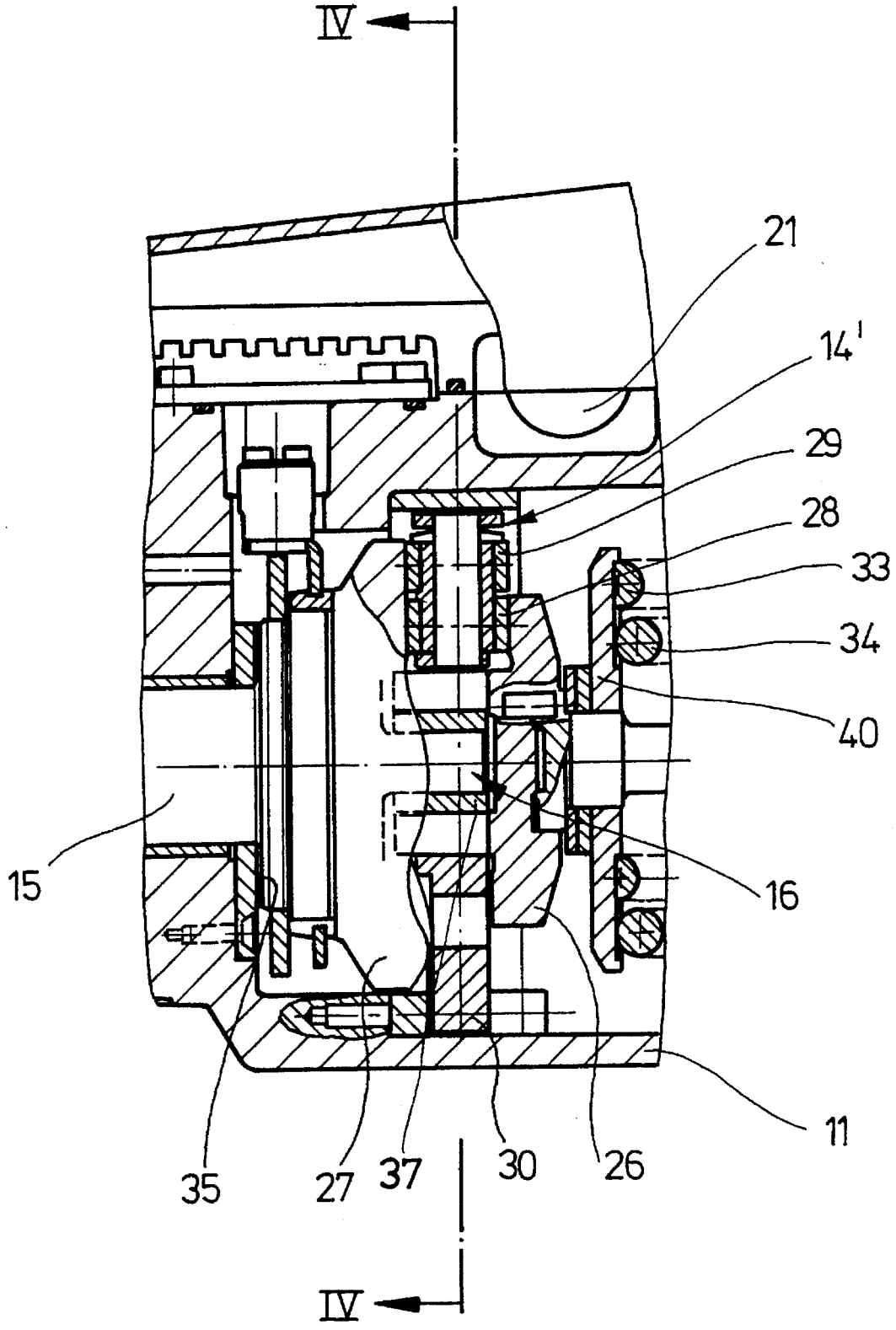
FIG. 3 shows in cutout a longitudinal section of a fuel injection pump in accordance with a second exemplary embodiment with a modified cam drive.
Figure 4:
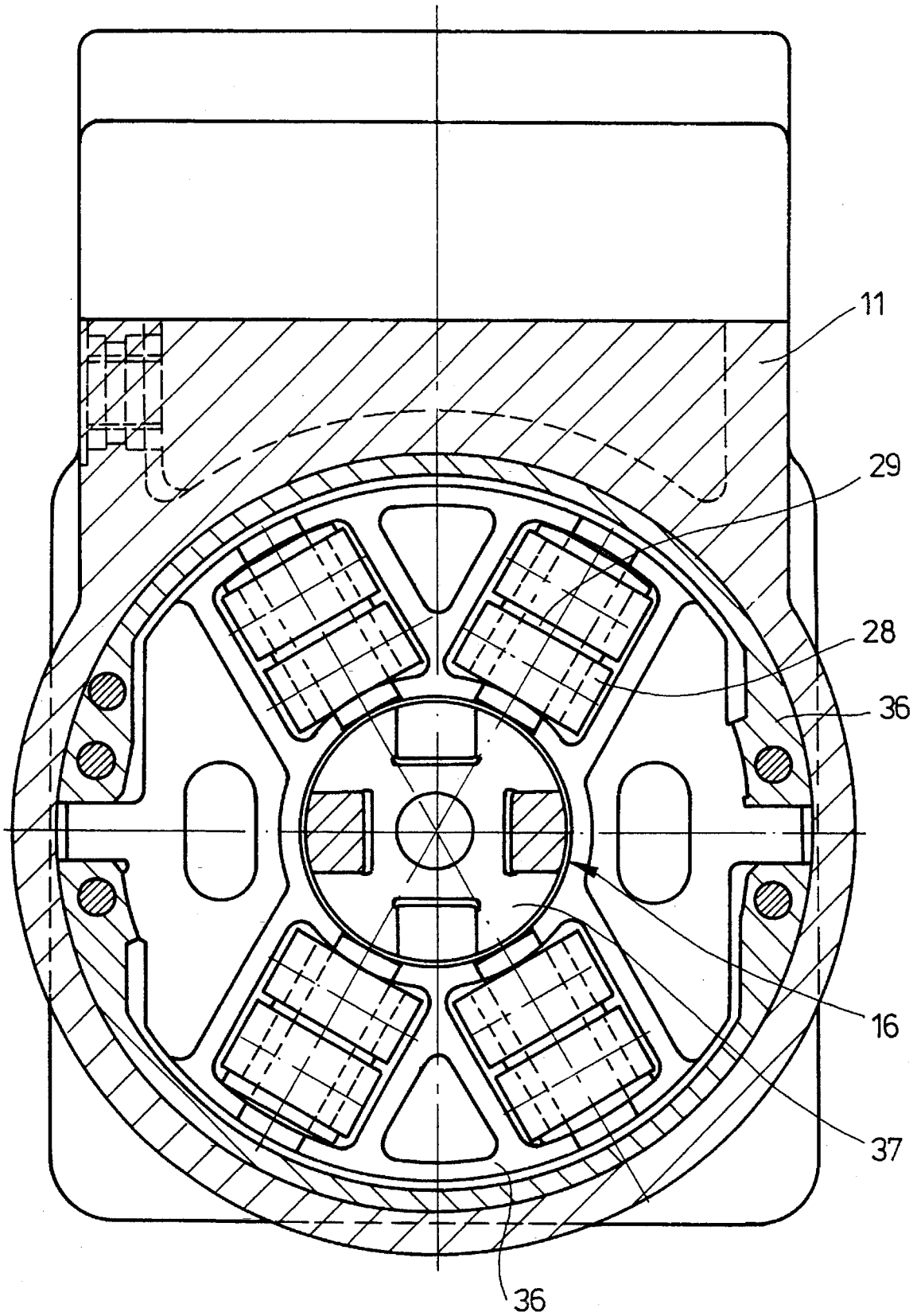
FIG. 4 shows a section along the line IV—IV in FIG. 3.

In contrast to the above-described fuel injection pump, the fuel injection pump in accordance with a further exemplary embodiment and shown in cutout in FIGS. 3 and 4 is modified only with respect to cam drive 14'. Here the diameter of the cam disk 26 connected to the pump piston 13 in a manner fixed against relative rotation is dimensioned smaller than the diameter of the second cam disk 27 connected to the drive shaft 15 in a manner fixed against relative rotation. The first rollers 28 and the second rollers 29 are respectively disposed one behind the other in the radial direction, with roller axes aligned in the same plane (FIG. 4). On the one hand, this structural embodiment of the cam drive 14' has the advantage that, because of the arrangement of the rollers 28, 29 in the same plane, the total length of the fuel injection pump is not greater than with conventional fuel injection pumps of the distributor type. On the other hand, the cam disk 26 on the side of the piston has a smaller mass due to its smaller diameter and subsequently the smaller cam race radius. Because of this, a smaller mass participates in the lifting motion of the pump piston 13, which has a very favorable effect on the control of the axial forces. In this case, the stroke of the pump piston 13 is not distributed 1:1 onto the two cam disks 26, 27; rather, the second cam disk 27 connected to the drive shaft 15 in a manner fixed against relative rotation takes on more than 50% of the total stroke because of its larger diameter and the associated larger cam race radius. The difference with regard to the stroke of the pump piston 13 is realized by means of the first cam disk 26 connected to the pump piston 13 in a manner fixed against relative rotation and again coupled to the drive shaft 15 in a manner fixed against relative rotation by means of a claw coupling 16. As in the fuel injection pump in FIGS. 1 and 2, the transfer of moment of the claw coupling is effected by means of a cross-type disk 37, which is seated on claws 38 of the drive shaft 15 and in turn, with claws 39, engages the first cam disk 26 connected to the pump piston 13 in a manner fixed against relative rotation.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump of the distributor type for a multicylinder internal combustion engine that has a number of fuel injection lines (24) that corresponds to the number of cylinders of the internal combustion engine, having a pump piston (13) that defines a pump work chamber (17), said pump piston generates a fuel injection pressure in the pump work chamber (17) by means of an axial lifting motion and connects the pump work chamber sequentially to one of the fuel injection lines (24) by means of rotational movement, a rotating drive shaft (15) coupled to the pump piston (13) in a manner fixed against relative rotation and in a manner that permits its axial lifting motion, a cam drive (14; 14') for axial drive of the pump piston (13) in the lifting direction and that supports an cam disk (26) connected to the pump piston (13) in a manner fixed against relative rotation and that has a number of front cams (31) corresponding to the number of engine cylinders, and at least one roller (28) that rolls off of the front cams (31) of the cam disk (26) and is rotatably held in a fixed roller holder (30), a relief conduit (19) connected to the pump work chamber (17) and having a magnet valve (18) that controls the relief conduit (19) and determines a beginning of pumping of the pump piston (13) by blocking the relief conduit (19) and the end of pumping by opening of the relief conduit (19), a second cam disk (27) having the same number of front cams (32) is connected to the drive shaft in a manner fixed against relative rotation; that at least one second roller (29) that rolls off of the front cams (32) of the second cam disk (27) is rotatably held in the roller holder (30), and that the roller holder (30) is guided to be axially displaceable.

2. The pump as defined by claim 1, in which the two cam disks (26, 27) have the same diameter and that the axes of the first and second rollers (28, 29) are offset with respect to one another in the axis direction of the roller holder (30).

3. The pump as defined by claim 2, in which the axial spacing of the axes of the first and second rollers (28, 29) is smaller than their diameter, and the axes of the first and second rollers (28, 29) are rotated sufficiently opposite one another that the rollers (28, 29) do not touch.

4. The pump as defined by claim 1, in which the diameter of the first cam disk (26) connected to the pump piston (13) in a manner fixed against relative rotation is smaller than the diameter of the second cam disk (27) connected to the drive shaft (15) in a manner fixed against relative rotation, and that the first and second rollers (28, 29) are disposed one behind the other with radially aligned axes.

5. The pump as defined by claim 1, in which a total of four first rollers (28) that rolls off of the first cam disk (26) connected to the pump piston (13) in a manner fixed against relative rotation and four second rollers (29) that roll off the second cam disk (27) connected to the drive shaft (15) in a manner fixed against relative rotation are disposed inside the roller holder (30).

6. The pump as defined by claim 2, in which a total of four first rollers (28) that rolls off of the first cam disk (26) connected to the pump piston (13) in a manner fixed against relative rotation and four second rollers (29) that roll off the second cam disk (27) connected to the drive shaft (15) in a manner fixed against relative rotation are disposed inside the roller holder (30).

7. The pump as defined by claim 3, in which a total of four first rollers (28) that rolls off of the first cam disk (26) connected to the pump piston (13) in a manner fixed against relative rotation and four second rollers (29) that roll off the second cam disk (27) connected to the drive shaft (15) in a manner fixed against relative rotation are disposed inside the roller holder (30).

8. The pump as defined by claim 4, in which a total of four first rollers (28) that rolls off of the first cam disk (26) connected to the pump piston (13) in a manner fixed against relative rotation and four second rollers (29) that roll off the second cam disk (27) connected to the drive shaft (15) in a manner fixed against relative rotation are disposed inside the roller holder (30).

* * * * *